US007617652B1

(12) United States Patent
Flatmoe

(10) Patent No.: US 7,617,652 B1
(45) Date of Patent: Nov. 17, 2009

(54) SUPPORT FRAME COMPONENT SYSTEM FOR DECKS

(76) Inventor: Kris O. Flatmoe, 1749 Lodge St., Rapid City, SD (US) 57702

( * ) Notice: Subject to any disclaimer, the term of this patent is extended or adjusted under 35 U.S.C. 154(b) by 468 days.

(21) Appl. No.: 11/097,698

(22) Filed: Apr. 1, 2005

(51) Int. Cl.
*E04H 12/00* (2006.01)

(52) U.S. Cl. ..... 52/653.2; 52/191; 52/263; 52/650.3

(58) Field of Classification Search ..... 52/7, 52/6, 263, 185, 183, 188, 182, 702, 712, 52/715, 191, 8, 9, 184, 220.3, 633, 650.3, 52/651.1, 653.1, 653; 108/92, 101, 45; 312/235.1; 182/45; 248/237, 276.1, 284.1
See application file for complete search history.

(56) References Cited

U.S. PATENT DOCUMENTS

| | | | | | |
|---|---|---|---|---|---|
| 718,612 | A | * | 1/1903 | Chase | 4/285 |
| 1,010,994 | A | * | 12/1911 | White | 248/237 |
| 2,287,561 | A | * | 6/1942 | Page et al. | 52/182 |
| 3,668,828 | A | * | 6/1972 | Nicholas et al. | 52/92.1 |
| 3,914,912 | A | * | 10/1975 | Rosenberg | 52/188 |
| 3,986,579 | A | * | 10/1976 | Howard | 182/194 |
| 4,229,919 | A | * | 10/1980 | Hughes | 52/263 |
| 4,285,173 | A | | 8/1981 | Grearson et al. | |
| 4,622,792 | A | * | 11/1986 | Betts | 52/263 |
| 4,644,708 | A | * | 2/1987 | Baudot et al. | 52/79.9 |
| 4,706,425 | A | * | 11/1987 | Brumbalough | 52/182 |
| 4,813,201 | A | * | 3/1989 | Parsons et al. | 52/7 |
| 4,819,391 | A | * | 4/1989 | Tassin et al. | 52/182 |
| 4,823,529 | A | * | 4/1989 | Canfield et al. | 52/263 |
| 4,917,217 | A | * | 4/1990 | Rogers et al. | 182/152 |
| 5,014,475 | A | * | 5/1991 | Anderson et al. | 52/191 |
| 5,050,353 | A | * | 9/1991 | Rogers et al. | 52/8 |
| 5,050,358 | A | * | 9/1991 | Vladislavic | 52/334 |
| 5,230,186 | A | | 7/1993 | Hammonds et al. | |
| 5,339,581 | A | * | 8/1994 | Schlickenmeyer | 52/177 |
| 5,558,312 | A | * | 9/1996 | Brennan | 256/65 |
| 5,625,995 | A | | 5/1997 | Martin | |
| 5,778,610 | A | * | 7/1998 | Berg | 52/182 |
| 5,956,916 | A | * | 9/1999 | Liss | 52/655.1 |
| 6,059,258 | A | * | 5/2000 | Jackson | 249/18 |
| 6,076,311 | A | | 6/2000 | Godfrey | |
| 6,088,977 | A | * | 7/2000 | Lawrence | 52/182 |
| 6,418,695 | B1 | * | 7/2002 | Daudet et al. | 52/677 |
| 6,427,403 | B1 | * | 8/2002 | Tambakis | 52/309.1 |
| 6,430,881 | B1 | * | 8/2002 | Daudet et al. | 52/92.2 |

(Continued)

*Primary Examiner*—Basil Katcheves
*Assistant Examiner*—William V Gilbert
(74) *Attorney, Agent, or Firm*—Jeffrey A. Proehl; Woods, Fuller, Shultz & Smith, PC

(57) ABSTRACT

A support frame system for a deck is disclosed, and comprises a deck support structure that may include a plurality of elongate joist components, at least one cross member component for supporting the joist components, a plurality of post components for supporting the at least one cross member component, and an edge component for extending along ends of the plurality of joist components. The support frame system may comprise a stair support structure that may include an elongated carriage component for orienting in an inclined orientation, a tread support component for mounting on the carriage component and extending outwardly from an upward side of the carriage component for positioning in a substantially horizontal orientation, and a riser support component for mounting between the carriage component and the tread support component for positioning in a substantially vertical orientation.

20 Claims, 8 Drawing Sheets

U.S. PATENT DOCUMENTS 6,470,644 B2 10/2002 James et al.
6,581,339 B2 * 6/2003 Thiede ..... 52/126.4
6,694,700 B1 2/2004 Mackett
6,742,311 B2 * 6/2004 Fortier ..... 52/185
6,763,912 B2 * 7/2004 Robinson et al. ..... 182/115
6,804,923 B1 * 10/2004 Potter ..... 52/480
2003/0009980 A1 * 1/2003 Shahnazarian ..... 52/712
2003/0167701 A1 9/2003 Rich
2004/0177569 A1 9/2004 Kim et al.

* cited by examiner 94
96
90
86
88
92

SUPPORT FRAME COMPONENT SYSTEM FOR DECKS

BACKGROUND OF THE INVENTION

1. Field of the Invention

The present invention relates to deck support framing and more particularly pertains to a new support frame component system for decks to provide support framing for a composite deck material that has a similar lifespan to the composite material and that is also easier to construct than using composite material and conventional framing techniques.

2. Description of the Prior Art

The use of deck support framing is known in the prior art. Typically, the support framing for the decking has been constructed out of material that is similar to the material which formed the decking. For example, a deck constructed out of a wood material, such as cedar or redwood, has been supported on a support frame that was also constructed out of a similar wood, so that the useful lifespan of the decking approximately matched the useful lifespan of the support framing. In this way, the support framing would not reach the end of its lifespan before the decking did, or vice versa.

Recently, new materials have been developed for use in decking, including materials such as polyvinylchlorides (vinyls), polyethylene, and composite materials that include various mixtures of wood fibers and plastic materials. These materials have been developed to have a significantly longer lifespan than conventional wood decking materials, as well as having other improved properties over wood, such as wear resistance. A significant drawback to these materials is the relative cost of the materials, which often can be justified by the longer lifespan of the material that in turn avoids the cost of more frequent replacement required with the relatively cheaper wood material. However, this less frequent cycle of replacement does not reduce the upfront building cost of these more expensive materials.

To reduce the cost of the initial installation, rather than using the composite materials for the support framing of the deck, it is tempting to use a relatively cheaper material (such as regular or "treated" wood) for the support framing for the composite decking material, as the support framing often does not receive the same exposure to wear and environmental elements as the decking material itself. However, since the lifespan of the composite material can be significantly longer than the wood used for the support framing, there is a definite possibility that the composite decking material may have to be removed from the wooden support framing structure once it has been compromised by age, even though the composite decking material itself has years of useful life left. Heretofore, the only way to avoid this possible scenario was to form the deck and support framing for the decking from the same material despite the significant upfront cost.

In these respects, the support frame component system according to the present invention substantially departs from the conventional concepts and designs of the prior art, and in so doing provides a system primarily developed for the purpose of providing support framing for a composite deck material that has a similar lifespan to the composite material and that is also easier to construct than using composite material and conventional framing techniques.

SUMMARY OF THE INVENTION

In view of the foregoing disadvantages inherent in the known types of deck support framing now present in the prior art, the present invention provides a new support frame component system wherein the same can be utilized for providing support framing for a composite deck material that has a similar lifespan to the composite material and that is also easier to construct than using composite material and conventional framing techniques.

In one aspect of the invention, the support frame system for a deck comprises a deck support structure that includes a plurality of elongate joist components, at least one cross member component for supporting the plurality of joist components, a plurality of post components for supporting the at least one cross member component, and an edge component for extending along ends of the plurality of joist components.

In some embodiments of the invention, the deck support structure may include an elongate ledger component for mounting on a structure adjoining the deck, and a mounting component for mounting an end portion of one of the components on a substantially vertical surface such as a side of the structure 2.

In another aspect of the invention, the support frame system for a deck comprises a stair support structure that includes an elongated carriage component for orienting in an inclined orientation with respect to the horizontal, a tread support component for mounting on the carriage component and extending outwardly from an upward side of the carriage component for positioning in a substantially horizontal orientation, and a riser support component for mounting between the carriage component and the tread support component for positioning in a substantially vertical orientation.

In some embodiments of the invention, the tread support component comprises a main portion and a tab portion for mounting on the carriage component. The tab portion extends from an end of the main portion and being bendable with respect to one side wall of the main portion for adjusting an orientation of the main portion with respect to the carriage component when the tread support component is mounted on the carriage component.

In some embodiments of invention, the riser support component comprises a main portion, a first end mounting portion on a first end of the main portion of the riser support component for mounting on an associated tread support component, and a second end mounting portion on a second end of the main portion of the riser support component for mounting on the carriage component. The first end mounting portion may include a pair of spaced, substantially parallel first tab walls mounted on a first end of the main portion, and the second end mounting portion may include a pair of spaced, substantially parallel second tab walls extending from the second end of the main portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is that the components of the support frame system provide a modular and easily assembled system that is formed of a strong and durable material yet avoids the need to weld the components together.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
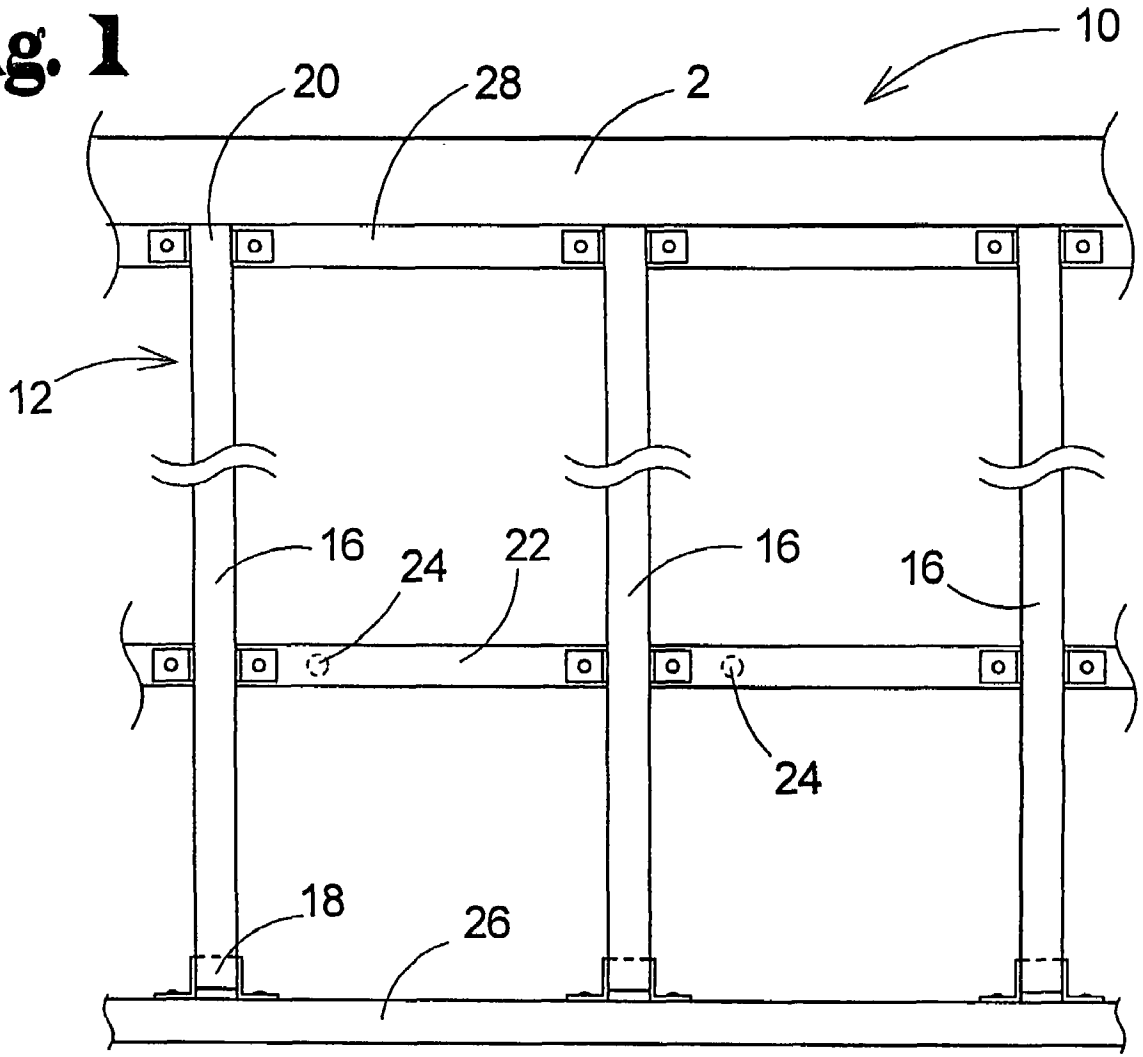
FIG. 1 is a schematic top view of a deck support structure of the new support frame component system according to the present invention.
Figure 2:
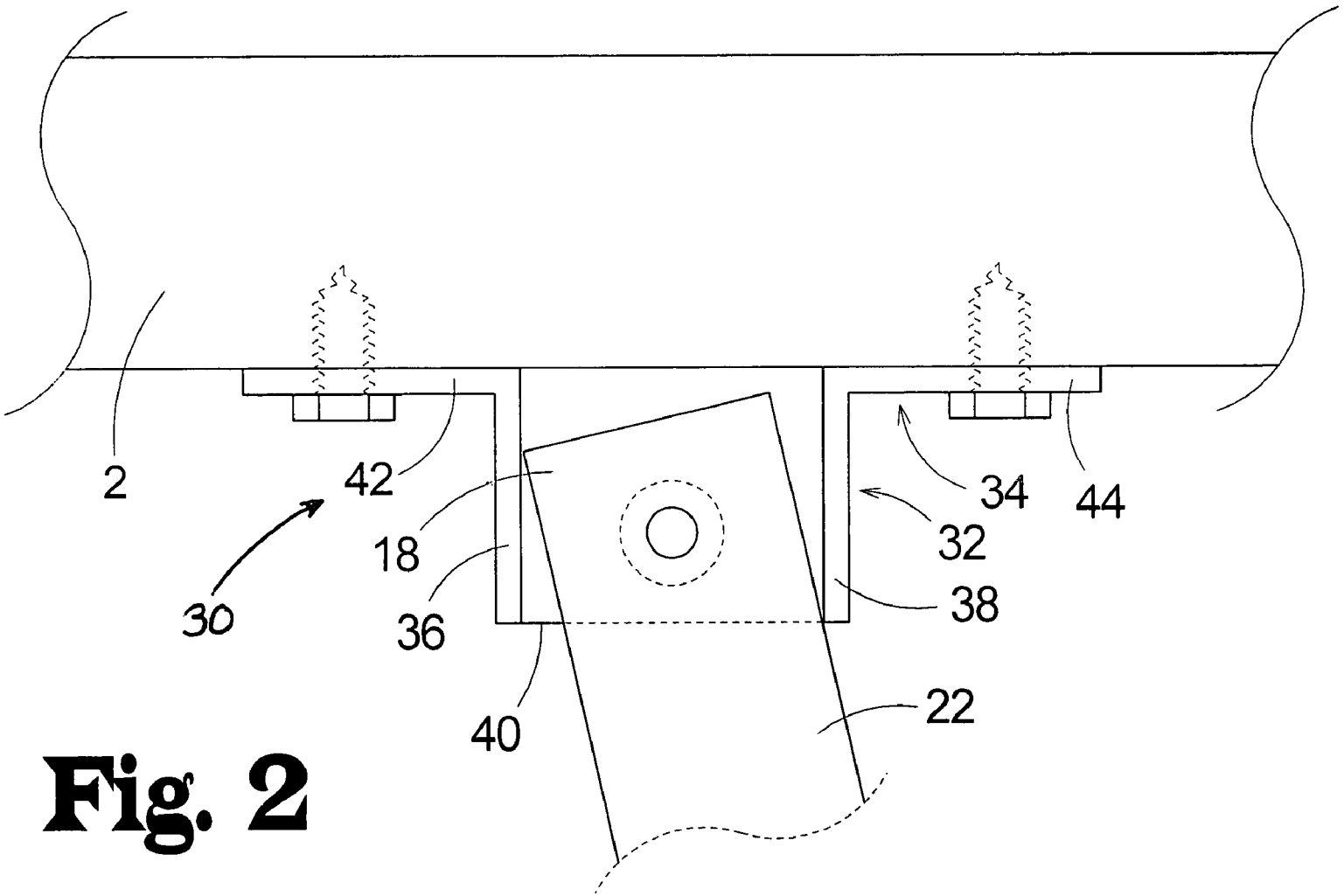
FIG. 2 is a schematic top view of a mounting component of the deck support structure of the present invention.
Figure 3:
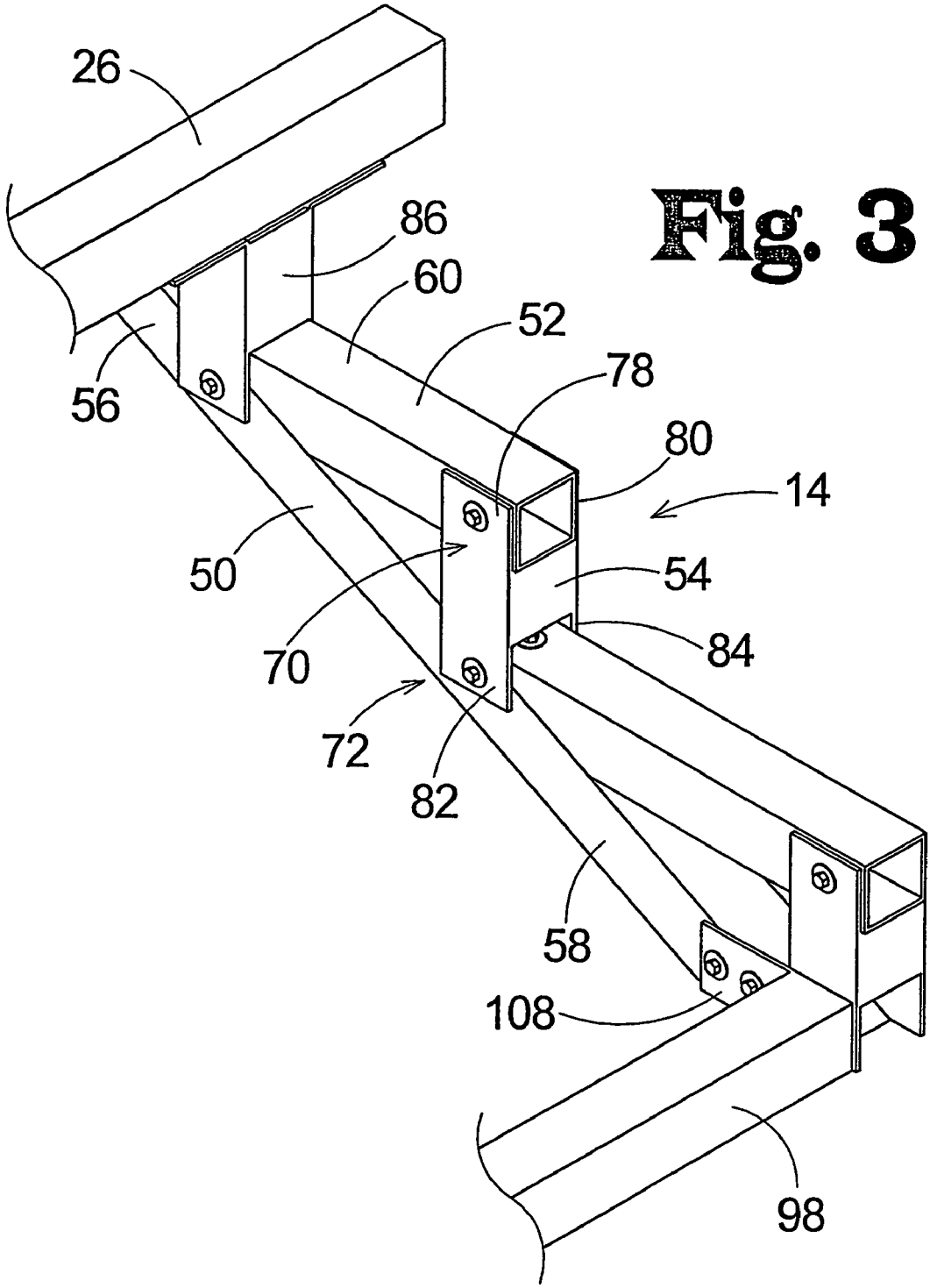
FIG. 3 is a schematic perspective view of the stair support structure of the support frame component system of the present invention.
Figure 4:
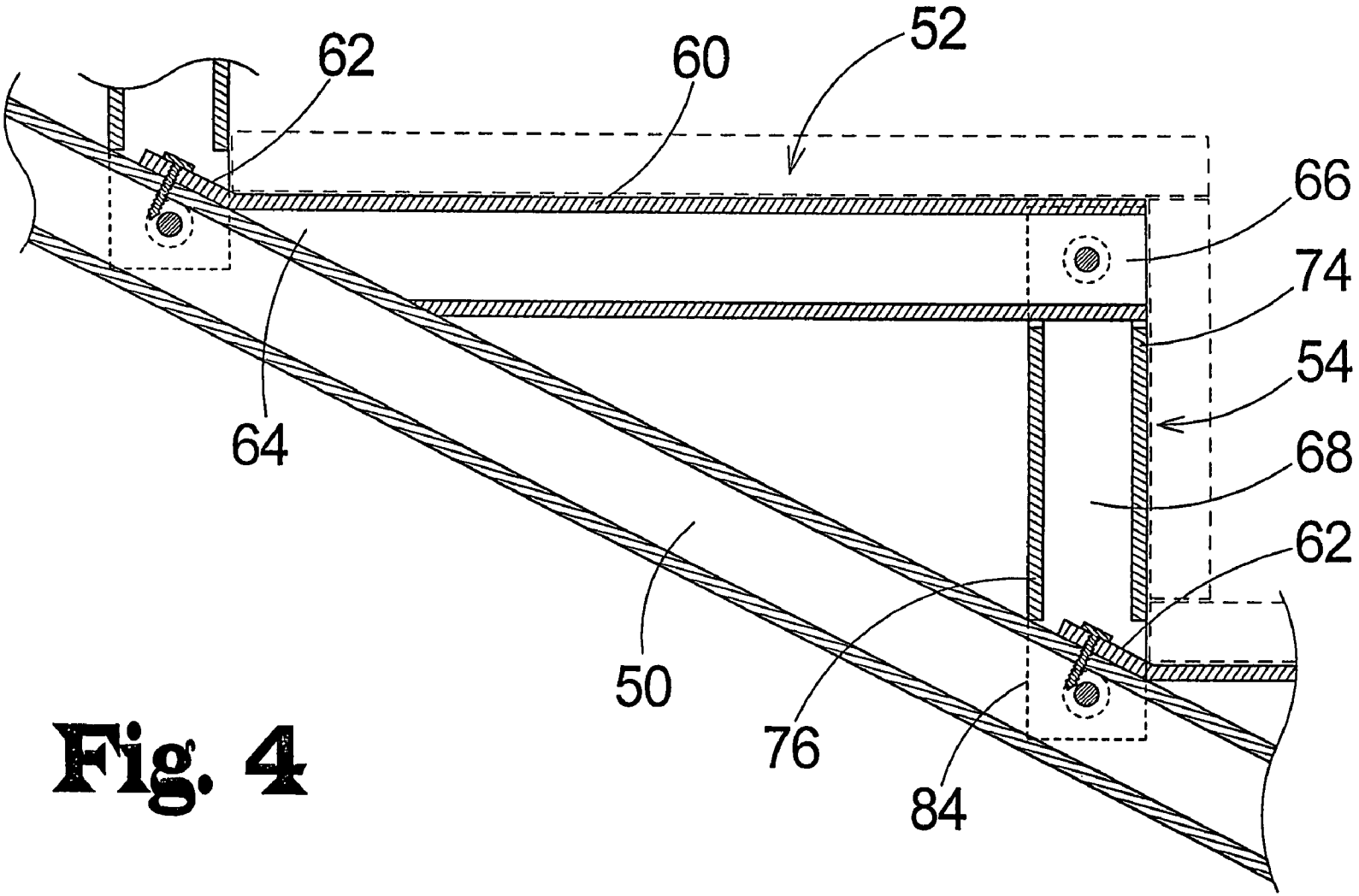
FIG. 4 is a schematic side sectional view of the stair support structure of the present invention.
Figure 5:
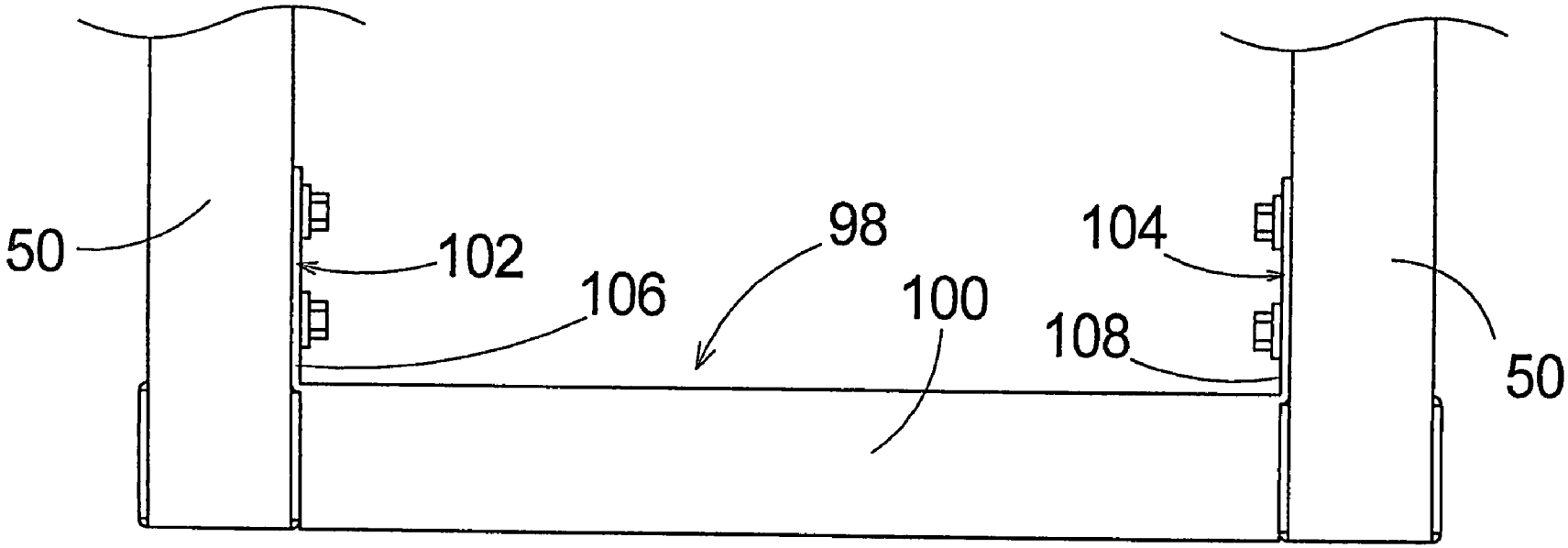
FIG. 5 is a schematic top view a carriage spacing component of the stair support structure of the present invention.
Figure 6:
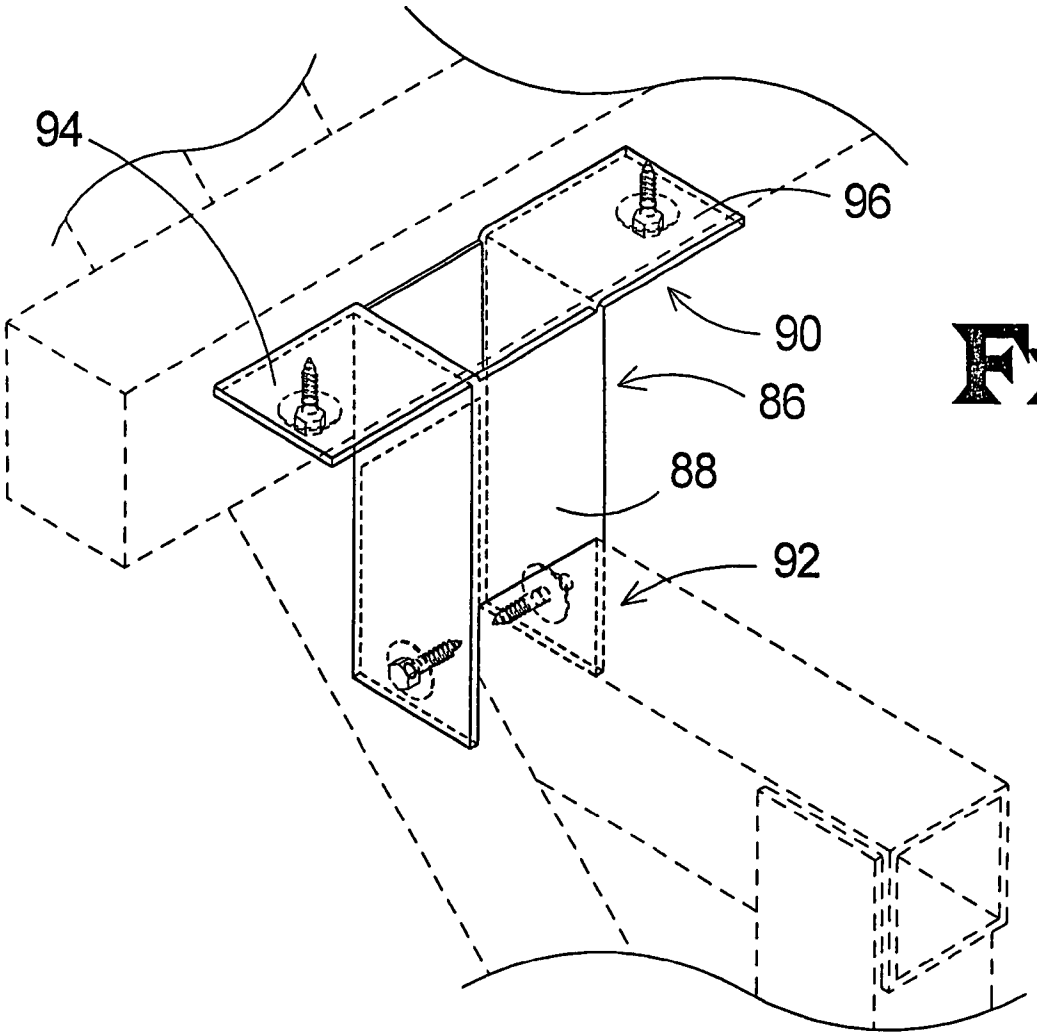
FIG. 6 is a schematic perspective view of a first configuration of an uppermost riser support component of the stair support structure of the present invention.
Figure 7:
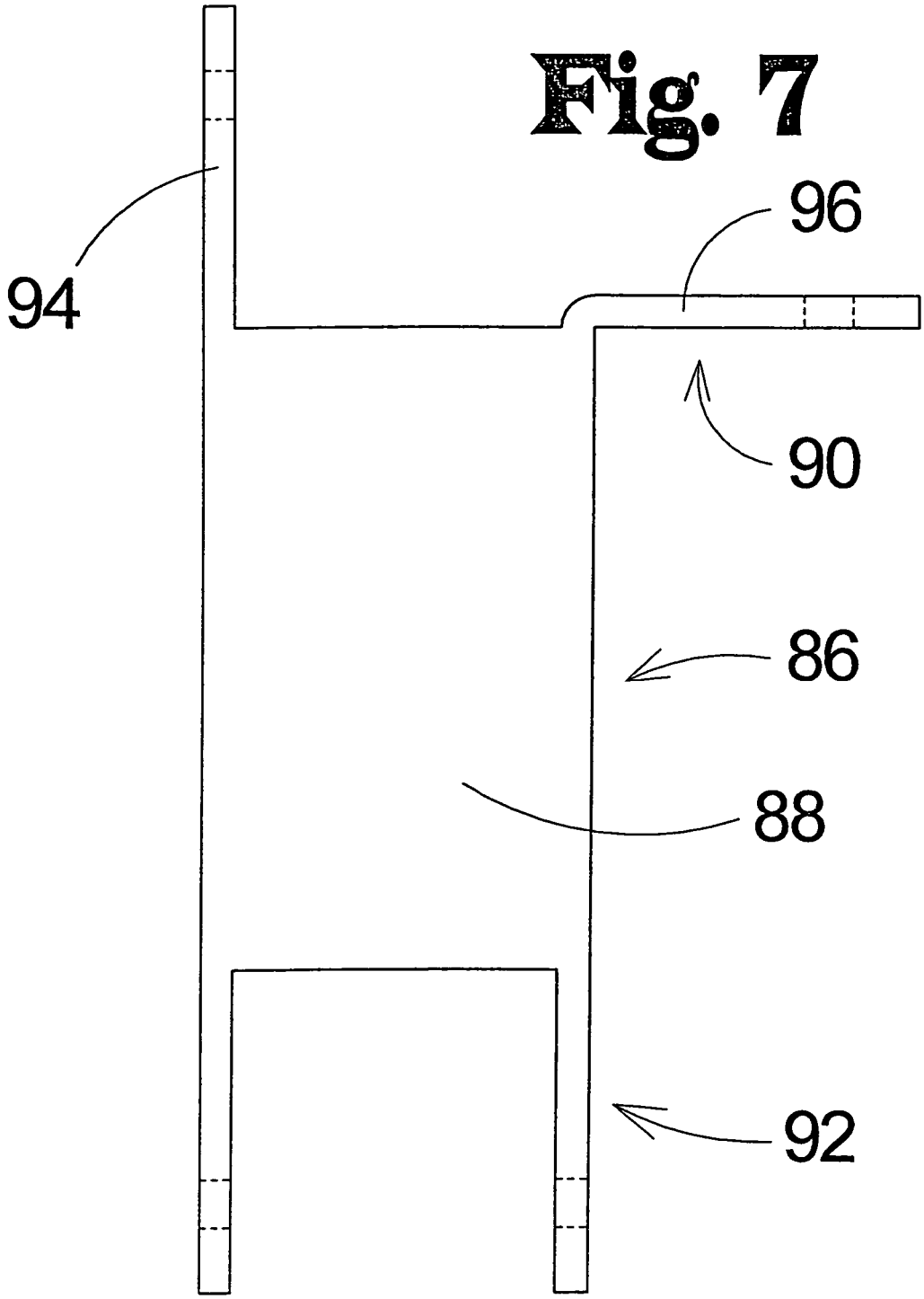
FIG. 7 is a schematic side view of a second configuration of an uppermost riser support component of the stair support structure of the present invention.
Figure 8:
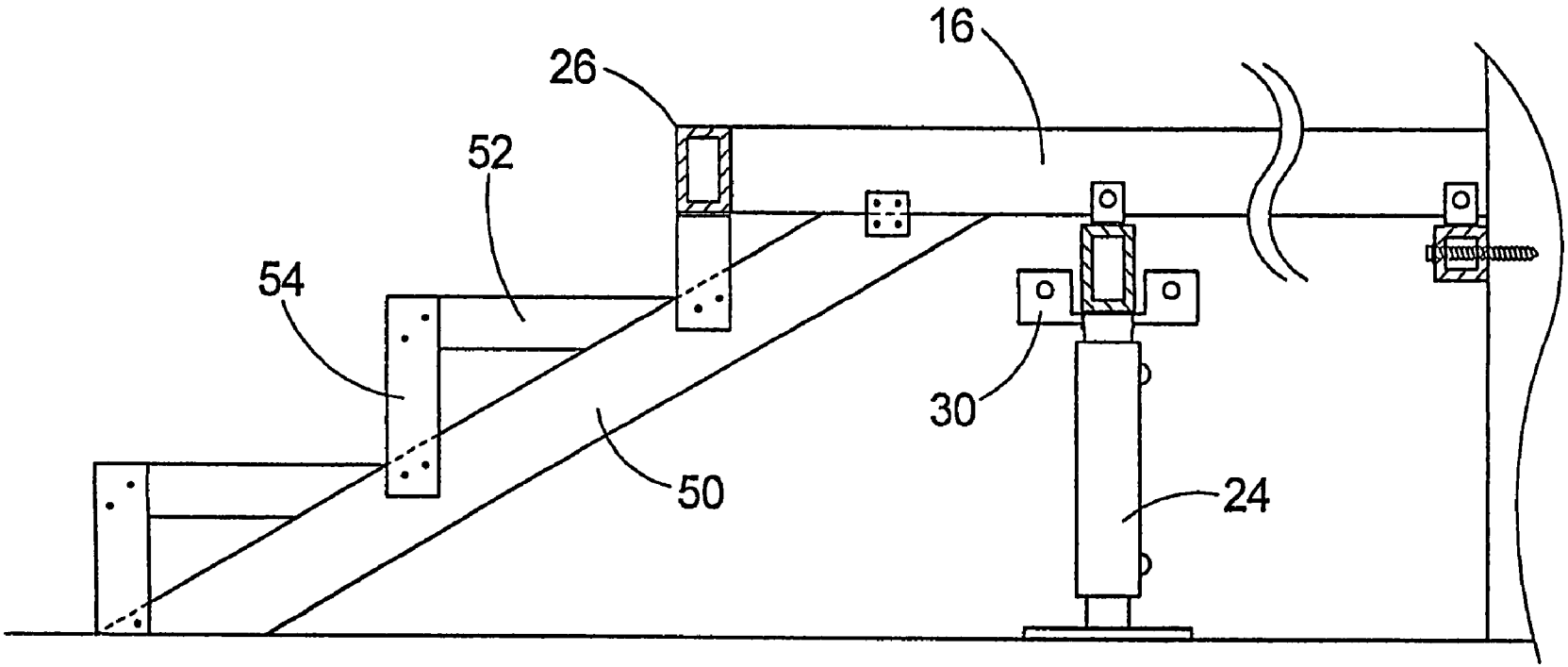
FIG. 8 is a schematic side view of the deck support structure and stair support structure of the present invention.

With reference now to the drawings, and in particular to FIGS. 1 through 8 thereof, a new support frame component system for decks embodying the principles and concepts of the present invention and generally designated by the reference numeral 10 will be described.

As illustrated generally in FIGS. 1 through 8, the support frame system 10 is highly suitable for supporting decking materials, generally in the form of elongate boards or planks that are typically, but not necessarily, approximately one to approximately two inches thick and between approximately four and approximately eight inches wide. Because of the extremely long potential lifespan of the material used to form the various components of the support frame system 10 of the invention, the system is also highly suitable for use to support decks of boards formed from composite materials that include plastics (such as vinyls) and in some cases wood fibers or other fillers. The support for these boards is provided by a deck support structure 12 of the system 10. The deck support structure 12 is suitable for creating a free standing deck, and also a deck that is located adjacent to building structure 2 and derives some support from the structure. The support frame system may also include a stair support structure 14 that supports boards forming a flight of stairs located adjacent to the deck.

As a preliminary matter, it should be recognized that the various components described herein may be fastened together in a number of ways known to those skilled in the art, but one highly preferably manner of connecting the components together is through the use of screws, either placed in holes that are predrilled in the component at the site of installation or of the self-tapping variety. The use of screws permits the various components to be connected that the points that are dictated by the particular installation, and also provides a measure of adjustment to be made in the positioning of the components at the job site. Also, L-shaped brackets may be employed to connect various components together, in concert with the fasteners.

The deck support structure 12 (see FIG. 1) of the invention includes a plurality of joist components 16, which are preferably elongate in nature with opposite ends 18, 20. The joist components 16 form the base on which the decking material are mounted. The boards may be formed of a composite material but also possibly formed of other materials, including wood. Each joist component 16 preferably comprises a tubular member.

The deck support structure 12 of the invention may also include at least one cross member component 22 that supports the plurality of joist components 16 in the deck support structure. The cross member component 22 may be positioned below the plurality of joist components 16, which may rest on the cross member component 22. The cross member component 22 may be oriented substantially perpendicular to the cross member component. The deck support structure 12 may also include a plurality of post components 24 (see FIG. 8) for supporting the cross member component 22, as well as other components if desired. The plurality of post components 24 may be substantially vertically oriented, and the cross member component 22 may be mounted on the plurality of post components. The post component 24 may include a plurality of pieces that facilitate adjustment of the height of the post. For example, the post component 24 may comprise an assembly of a post member, a blind receiver member positionable on a lower surface such as the ground, and a beam to post receiver member for mounting the post component assembly to the cross member component 22.

The deck support structure 12 may also include an edge component 26 for extending along ends of the plurality of joist components 16. The edge component 26 may extend substantially perpendicular to the plurality of joist components 16, and may be abutted against the end of each of the plurality of joist components or optionally position below the joist components. Preferably, the edge component 26 is mounted to each of the plurality of joist components 16, such as by, for example, an L-shaped bracket fastened to each of the components. The deck support structure 12 may also include a ledger component 28 for mounting on a structure 2, such as a building, that adjoins the deck. The ledger component 28 may comprise an elongate tubular member that is fastened to a substantially vertical surface on the structure 2.

In one significant aspect of the invention, the deck support structure 12 includes a plurality of mounting components 30 (see FIG. 2) for mounting an end of the cross member component 22, or even a joist component 16 on a vertical or substantially vertical surface, or even on other components of the system 10. For example, the mounting component 30 may be employed to support an end of the cross member component 22, or an end 18 of one of the joist components 16 at a spaced location from the cross member component 22. Each of the mounting components 30 may comprise a channel portion 32 and a flange portion 34. The channel portion 32 receives an end portion (adjacent to the end) of one of the components. The channel portion 32 may have a substantially U-shaped configuration, with a pair of spaced side walls 36, 38 and a bottom wall 40 that extends between and may connect the side walls. Significantly, a spacing distance between the side walls 36, 38 of the channel portion 32 is preferably greater than a transverse width of the end portion of the component to be supported. The spacing distance greater than the width permits the supported component to be in a skewed orientation to the vertical surface (to which the component is to be mounted by the mounting component) that is not precisely perpendicular to the orientation of the component. In such a case, a longitudinal axis of the supported component is oriented at a non-zero angle with respect to one of the side walls 36, 38 of the channel portion 32, and conversely is oriented at a non-perpendicular angle to the supported component. Preferably, the spacing distance between the side walls 36, 38 may be between approximately 105% and approximately 150% of the transverse width of the end portion of the supported component, and the spacing distance may be between approximately 110% and approximately 130% of the transverse width of the end portion of the supported component. The excess space between the side walls 36, 38 thus permits the end portion of the joist component 16 to be positioned in the channel portion 32 even if the supported component and the mounting component are not perfectly aligned. The side walls 36, 38 of the channel portion 32 may be oriented substantially parallel to each other, and the bottom wall 40 may be oriented substantially perpendicular to the side walls.

The flange portion 34 of the mounting component 30 is mounted on the channel portion 32 and mounts the channel portion to the vertical or substantially vertical surface. The flange portion 34 comprises a pair of tab walls 42, 44. Each of the tab walls 42, 44 is mounted on one of the side walls 36, 38 of the channel portion 32 and extends away from the channel portion. Each of the tab walls 42, 44 may extend substantially perpendicular to the side wall of the channel portion on which the respective tab wall is mounted. The tab walls 42, 44 may be oriented in a substantially coplanar relationship to each other.

The stair support structure 14 of the invention provides support for elements (such as boards) forming a flight of steps on the deck support structure 12. The stair support structure 14 for a flight of stairs generally comprises a plurality of carriage components 50, and a tread support component 52 and a riser support component 54 for each of the steps of the flight of stairs. At least two, and optionally three, carriage components 50 are positioned in an inclined orientation with respect to the horizontal, and extend at an upper end from one of the joist components 16 toward the ground. The carriage component 50 has the plurality of tread support components 52 and the plurality of riser support components 54 mounted thereon to form the foundation of each of the steps of the flight of stairs.

The carriage component 50 (see FIGS. 3 and 4) may comprise a tubular member of substantially uniform cross section along a length of the carriage component, and may be similar to the material forming the joist components. The carriage component 50 has opposite ends 56, 58. A first end 56 of the carriage component 50 may have a bevel on a first side of the carriage component and a second end 58 of the carriage component may have a bevel on a second side of the carriage component that is opposite of the first side of the carriage component. The first side of the carriage component is oriented generally upward and the second side of the carriage component is oriented generally downwardly, such that the bevel of the first end is abuttable against the underside of a joist component on which it is mounted. The bevel of the second end of the carriage component may be rested on a ground surface, or a lower deck surface.

The tread support component 52 is mountable on the carriage component 50 to extend in a substantially horizontal orientation outwardly from an upward side of the carriage component. In the finished stair structure, a deck element or board is attached to the tread support component 52 to form a tread of the flight of stairs. The tread support component may include a main portion 60 and a tab portion 62. The main portion 60 is generally elongate and has opposite ends 64, 66. The main portion 60 may be tubular in character, and may have a plurality of side walls such that the main portion has a substantially rectangular cross sectional shape. The tab portion 62 extends from an end 64 of the main portion 60, and from one of the plurality of side walls. The tab portion 62 is substantially planar with respect to one side wall of the main portion 60. The tab portion 62 is preferably bendable with respect to the one side wall of the main portion 60 in order to adjust the orientation of the tread with respect to the carriage component 50 to make the tread horizontal. With this characteristic, the same basic size of tread support component 52 may be used with a number of different sizes of riser support components 54 merely by adjusting the angle of bend between the tab portion 62 and the side wall of the main portion 60. As the riser support component 54 is preferably formed of a metal, the bending may be relatively easily accomplished at the installation site.

The riser support component 54 is mountable between the carriage component 50 and the tread support component 52 in a substantially vertical orientation. In the finished stair structure, a deck element or board is attached to the riser support component 54 to form a riser of the flight of stairs. The riser support component 54 comprises a main portion 68, a first end mounting portion 70, and a second end mounting portion 72. The main portion 68 is generally elongate in nature and has opposite ends, including a first end 74 and a second end 76. The main portion 68 may comprise a tubular member with a plurality of side walls that form a substantially rectangular cross sectional shape. The first end mounting portion 70 on the first end 74 of the main portion 68 of the riser support component 54 mounts on an associated tread support component 52 of the particular stair step. The first end mounting portion 70 includes a pair of first tab walls 78, 80 that are spaced from each other so that a spacing distance between the first tab walls is just slightly greater than a transverse width of the main portion 60 of the tread support component 52. The first tab walls 78, 80 may be oriented substantially parallel to each other, and each first tab wall extends from one of opposite side walls of the main portion 60. The second end mounting portion 72 on the second end 76 of the main portion 68 of the riser support component 54 for mounting on the carriage component 50. The second end mounting portion 72 comprises a pair of second tab walls 82, 84. The pair of second tab walls 82, 84 may be oriented substantially parallel to each other, with a first one 82 of the second tab walls being oriented substantially parallel to the side wall of the main portion on which it is mounted and a second one 84 of the second tab walls being oriented substantially parallel to the side wall of the main portion on which it is mounted. The second tab walls 82, 84 extend from opposite side walls of the main portion 60. Each of the second tab walls 82, 84 may extend from the same side wall of the main portion from which one of the first tab walls 78, 80 extends. Significantly, a degree of job site adjustment of the orientation and position of the riser support component 54 may be made by the particular positioning of the saddle formed by the second tab walls 82, 84 on the carriage component 50 and similarly, the position of the saddle formed by the first tab walls 78, 80 on the tread support component 52. When the fasteners, such as screws, are positioned at the job site, the positioning of these saddles is made more flexible and adjustable.

Optionally, an uppermost riser support component 86 (see FIG. 6) may be employed for positioning between, and is mountable to, the carriage component 50 and the edge component 26 of the deck support structure. The uppermost riser support component 86 may comprise a main portion 88, a first end mounting portion 90, and a second end mounting portion 92. The main portion 88 of the uppermost riser support component 86 is substantially similar to the main portion 68 of the riser support component 54. The second end mounting portion 92 is also substantially similar to the second end mounting portion 72 of the riser support component 54. The first end mounting portion 90 on the first end of the main portion 88 of the uppermost riser support component 86 is mountable on an associated tread support component 52. The first end mounting portion 90 includes a pair of first tab walls 94, 96. In a variation from the first end mounting portion 70 of the riser support component 54, each of the tab walls 94, 96 of the uppermost riser support component 86 is oriented substantially perpendicular to the side wall of the main portion 88 on which it is mounted. The tab walls 94, 96 extend away from each other in opposite directions for mounting on the underside of the edge component 26. In an optional variation of the uppermost riser support component, shown in FIG. 7, a first one of the tab walls 94 is oriented substantially parallel to the side wall of the main portion on which it is mounted, and a second one of the tab walls 96 is oriented substantially perpendicular to the side wall of the main portion on which it is mounted.

The stair support structure 14 may also include a carriage spacer component 98 (see FIG. 5) for positioning between adjacent carriage components 50 to hold the carriage components in the spaced condition in the stair support structure. The carriage spacer component comprises a main portion 100, a first end mounting portion 102, and a second end mounting portion 104. The main portion 100 may be substantially similar to the main portion of the other components. The first end mounting portion 102 is provided on the first end of the main portion 100 of the carriage spacer component 98 for mounting on an associated carriage component 50. The first end mounting portion 102 may include a first tab wall 106 that extends substantially perpendicular to the side wall of the main portion 100. The second end mounting portion 104 is provided on the second end of the main portion 100 of the carriage spacer component 98 for mounting on an associated carriage component 50. The second end mounting portion 104 may include a second tab wall 108 that extends substantially perpendicular to the side wall of the main portion 100 on which it is mounted.

The aforedescribed components of the system 10 may be formed of various materials, but the components are most suitably formed of a material that has a relatively long lifespan that is comparable to or exceeds the lifespan of the composite boards of the preferred decking material. In the most preferred embodiments is formed of a steel material that is treated with a galvanizing material. One highly preferred galvanizing material is FLO-COAT 50, available from TubularUSA, 830 Westwood Industrial Park Drive, Weldon Spring, Mo., 63304. However, it should be understood that other suitable materials, both formed of metal and formed of other materials such as composites, may be used to form the components of the system 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support frame system for a deck, comprising:

a deck support structure comprising:

a plurality of elongate tubular joist components;

at least one elongate tubular cross member component supporting the plurality of joist components;

a plurality of post components supporting the at least one elongate tubular cross member component; and an edge component extending along and attached to ends of the plurality of joist components; and an elongate tubular ledger component for mounting on a structure adjoining the deck support structure;

wherein ends portions of the plurality of elongate tubular joist components rest upon and are supported by the elongate tubular ledger component;

wherein at least one of the plurality of elongate tubular joist components rests upon the at least one elongate tubular cross member component such that the at least one elongate tubular cross member component supports the plurality of elongate tubular joist components;

wherein the at least one elongate tubular cross member component has a longitudinal axis that is oriented substantially perpendicular to a longitudinal axis of the at least elongate tubular joist component resting on the elongate tubular cross member component;

a mounting component for mounting on a substantially vertical surface to support an end of one of the components on the substantially vertical surface, the mounting component comprising:

a channel portion receiving an end portion of one of the components; and a flange portion mounted on the channel portion for mounting the channel portion to the substantially vertical surface;

wherein the channel portion has a substantially U-shaped configuration with a pair of spaced side walls and a bottom wall connecting the side walls;

wherein a spacing distance between the side walls of the channel portion is greater than a transverse width of the end portion of the component received in the channel portion, the spacing distance between the side walls being sufficiently greater such that a longitudinal axis of the component received in the channel portion is capable of being oriented at a non-zero angle with respect to one of the side walls of the channel portion.

2. The system of claim 1 wherein the at least one elongate tubular cross member rests on a top end of the plurality of post components.

3. The system of claim 1 wherein the flange portion of the mounting component comprises a pair of tab walls, each of the tab walls being mounted on the channel portion and extending away from the channel portion.

4. The system of claim 3 wherein each of the tab walls extends substantially perpendicular to the side wall of the channel portion on which it is mounted, the tab walls being substantially coplanar with each other.

5. The system of claim 3 wherein the tab walls of the pair of tab walls extend in substantially opposite directions.

6. The system of claim 1 wherein the spacing distance is between approximately 105% and approximately 150% of the transverse width of the end portion of the component received in the channel portion.

7. The system of claim 1 additionally comprising:

wherein the flange portion comprises a pair of tab walls, each of the tab walls being mounted on one of the side walls of the channel portion and extending away from the channel portion;

wherein each of the tab walls extends substantially perpendicular to the side wall of the channel portion on which it is mounted, the tab walls being substantially coplanar with each other;

and wherein the spacing distance is between approximately 105% and approximately 150% of the transverse width of the end portion of the component.

8. The system of claim 1 wherein a bottom surface of the ends portions of the plurality of elongate tubular joist components rest upon a top surface of the elongate tubular ledger component.

9. A support frame system for a deck, comprising:

a stair support structure comprising:

an elongated carriage component oriented in an inclined orientation with respect to the horizontal;

a tubular tread support component mounted on the carriage component and extending outwardly from an upward side of the carriage component in a substantially horizontal orientation; and a tubular riser support component mounted between the carriage component and the tread support component in a substantially vertical orientation;

wherein the tread support component comprises:

main portion; and a tab portion on mounted to the carriage component, the tab portion extending from an end of the main portion and being bendable with respect to one side wall of the main portion for adjusting an orientation of the main portion with respect to the carriage component when the tread support component is mounted on the carriage component;

wherein the tab portion rests upon an upper surface of the carriage component between the riser support component and the carriage component, a fastener connecting the tab portion to the carriage component; and an uppermost riser support component positioned between the carriage component and an edge component of a deck support structure, the uppermost riser support component being mounted to the carriage component and the edge component.

10. The system of claim 9 wherein the main portion of the tubular tread support component comprises a perimeter wall with at least three sides, and wherein the tab portion comprises a continuation of one of the sides of the perimeter wall of the main portion.

11. The system of claim 9 wherein the riser support component comprises:

a main portion;

a first end mounting portion on a first end of the main portion of the riser support component for mounting on an associated tread support component; and a second end mounting portion on a second end of the main portion of the riser support component for mounting on the carriage component.

12. The system of claim 11 wherein the first end mounting portion includes a pair of spaced, substantially parallel first tab walls mounted on a first end of the main portion; and wherein the second end mounting portion comprising a pair of spaced, substantially parallel second tab walls extending from the second end of the main portion.

13. The system of claim 12 wherein the pair of first tab walls extend outwardly from the main portion of the riser support component in a first direction and the second pair of tab walls extend outwardly from the main portion in a second direction, the first and second directions being substantially oppositely directed.

14. The system of claim 9 wherein the uppermost riser support component comprises:

a main portion;

a first end mounting portion on the first end of the main portion of the uppermost riser support component for mounting on an associated tread support component, the first end mounting portion including a pair of first tab walls, the first tab walls being oriented substantially perpendicular to the side walls of the main portion; and a second end mounting portion on the second end of the main portion of the uppermost riser support component for mounting on the carriage component, the second end mounting portion comprising a pair of spaced, substantially parallel second tab walls.

15. The system of claim 9 wherein the uppermost riser support component comprises:

a main portion;

a first end mounting portion on the first end of the main portion of the uppermost riser support component for mounting on an associated tread support component, the first end mounting portion including a pair of first tab walls, a first one of the first tab walls being oriented substantially perpendicular to a side wall of the main portion on which it is mounted and a second one of the first tab walls being oriented substantially parallel to a side wall of the main portion on which it is mounted; and a second end mounting portion on the second end of the main portion of the uppermost riser support component for mounting on the carriage component, the second end mounting portion comprising a pair of spaced, substantially parallel second tab walls.

16. The system of claim 9 wherein the stair support structure additionally comprises a carriage spacer component for positioning between adjacent carriage components, the carriage spacer component comprising:

a main portion; and a first end mounting portion on the first end of the main portion of the carriage spacer component for mounting on an associated carriage component, the first end mounting portion including a first tab wall extending substantially perpendicular to a side wall of the main portion on which it is mounted; and a second end mounting portion on the second end of the main portion of the carriage spacer component for mounting on an associated carriage component, the second end mounting portion comprising a second tab wall extending substantially perpendicular to a side wall of the main portion on which it is mounted.

17. The system of claim 9 wherein the tread support component is positioned above an upper edge surface of the elongated carriage component; and wherein the riser support component is positioned above an upper edge of surface of the elongated carriage component.

18. The system of claim 9 wherein the stair support structure includes:

a pair of the carriage components positioned in a spaced and substantially parallel relationship;

a pair of the tread support components, each of the tread support components being mounted on and positioned over a respective one of the carriage components, the pair of tread support components being positioned in a spaced and substantially parallel relationship;

a pair of the riser support components, each of the riser support components being mounted on and positioned over a respective one of the carriage components, the pair of riser support components being positioned in a spaced and substantially parallel relationship.

19. The system of claim 9 wherein the main portion of the tubular tread support component comprises a perimeter wall with at least three sides, and wherein the tab portion comprises a continuation of one of the sides of the perimeter wall of the main portion;

wherein the riser support component comprises:

a main portion;

a first end mounting portion on a first end of the main portion of the riser support component for mounting on an associated tread support component; and a second end mounting portion on a second end of the main portion of the riser support component for mounting on the carriage component;

wherein the first end mounting portion includes a pair of spaced, substantially parallel first tab walls mounted on a first end of the main portion; and wherein the second end mounting portion comprising a pair of spaced, substantially parallel second tab walls extending from the second end of the main portion;

wherein the uppermost riser support component comprises:

a main portion;

a first end mounting portion on the first end of the main portion of the uppermost riser support component for mounting on an associated tread support component, the first end mounting portion including a pair of first tab walls, the first tab walls being oriented substantially perpendicular to the side walls of the main portion; and a second end mounting portion on the second end of the main portion of the uppermost riser support component for mounting on the carriage component, the second end mounting portion comprising a pair of spaced, substantially parallel second tab walls;

wherein the uppermost riser support component comprises:

a main portion;

a first end mounting portion on the first end of the main portion of the uppermost riser support component for mounting on an associated tread support component, the first end mounting portion including a pair of first tab walls, a first one of the first tab walls being oriented substantially perpendicular to a side wall of the main portion on which it is mounted and a second one of the first tab walls being oriented substantially parallel to a side wall of the main portion on which it is mounted; and a second end mounting portion on the second end of the main portion of the uppermost riser support component for mounting on the carriage component, the second end mounting portion comprising a pair of spaced, substantially parallel second tab walls;

wherein the stair support structure additionally comprises a carriage spacer component for positioning between adjacent carriage components, the carriage spacer component comprising:

a main portion; and a first end mounting portion on the first end of the main portion of the carriage spacer component for mounting on an associated carriage component, the first end mounting portion including a first tab wall extending substantially perpendicular to a side wall of the main portion on which it is mounted; and a second end mounting portion on the second end of the main portion of the carriage spacer component for mounting on an associated carriage component, the second end mounting portion comprising a second tab wall extending substantially perpendicular to a side wall of the main portion on which it is mounted.

20. A support frame system for a deck, comprising:

a deck support structure comprising:

a plurality of elongate tubular joist components, each of the plurality of joist components having opposite ends;

at least one elongate tubular cross member component supporting the plurality of joist components, the at least one cross member component being oriented substantially perpendicular to the at least one cross member component;

a plurality of tubular post components supporting the at least one cross member component, the plurality of post components being substantially vertically oriented, the at least one cross member component being mounted on the plurality of post components;

an elongate tubular edge component mounted on and extending along ends of the plurality of joist components, the edge component extending substantially perpendicular to the plurality of joist components;

an elongate tubular ledger component for mounting on a structure adjoining the deck support structure;

wherein ends portions of the plurality of elongate tubular joist components rest upon and are supported by the elongate tubular ledger component;

wherein at least one of the plurality of elongate tubular joist components rests upon the at least one cross member component such that the at least one cross member component supports the at least one elongate tubular joist component; and wherein the at least one cross member component has a longitudinal axis that is oriented substantially perpendicular to a longitudinal axis of the at least elongate tubular joist component resting on the cross member component;

a plurality of mounting components mounted on a substantially vertical surface and supporting an end of one of the components on the substantially vertical surface, each of the mounting components comprising:

a channel portion for receiving an end portion of one of the components, the channel portion having a substantially U-shaped configuration, the channel portion including a pair of spaced side walls and a bottom wall connecting the side walls; and a flange portion mounted on the channel portion and mounting the channel portion to the substantially vertical surface, the flange portion comprising a pair of tab walls, each of the tab walls being mounted on one of the side walls of the channel portion and extending away from the channel portion, the tab walls of the pair of tab walls extending in substantially opposite directions; and a stair support structure for supporting a flight of steps on the deck support structure, the stair support structure comprising:

a pair of elongate hollow tubular carriage components oriented in an inclined orientation with respect to the horizontal, the pair of the carriage components being positioned in a spaced and substantially parallel relationship;

a plurality of hollow tubular tread support components mounted on the carriage component and extending outwardly from an upward side of the carriage component in a substantially horizontal orientation, at least one of the tread support components being positioned over the upward side of one of the carriage components, each of the tread support components comprising:

an elongate main portion with opposite ends; and a tab portion extending from one of the ends of the main portion, the tab portion being bendable with respect to the said one side wall of the main portion to adjust the orientation of the main portion with respect to the carriage component;

a plurality of hollow tubular riser support components mounted between the carriage component and the tread support component in a substantially vertical orientation, at least one of the riser support components being positioned over the upward side of one of the carriage components, each of the riser support components comprising:

a main portion having opposite ends; and a first end mounting portion on the first end of the main portion of the riser support component for mounting on an associated tread support component, the first end mounting portion including a pair of spaced, substantially parallel first tab walls; and a second end mounting portion on the second end of the main portion of the riser support component for mounting on the carriage component, the second end mounting portion comprising a pair of spaced, substantially parallel second tab walls.

* * * * *